US006052338A

United States Patent [19]

Shevins

[11] Patent Number: 6,052,338

[45] Date of Patent: Apr. 18, 2000

[54] WRISTWATCH WITH AN ILLUMINATED ORNAMENTAL DISPLAY SYSTEM

[76] Inventor: Herbert Shevins, 209 Gulf Blvd., Indian Rocks Beach, Fla. 33785

[21] Appl. No.: 09/296,922

[22] Filed: Apr. 22, 1999

[51] Int. Cl.[7] ..... G04B 19/00; G04B 19/04; G04B 37/00

[52] U.S. Cl. ..... 368/223; 368/228; 368/285

[58] Field of Search ..... 368/76, 80, 223, 368/228, 232, 276, 278, 285, 309; D10/123, 124, 31

[56] References Cited

U.S. PATENT DOCUMENTS

| | | | |
|---|---|---|---|
| 1,446,082 | 2/1923 | Applegate | 368/278 |
| 1,591,512 | 7/1926 | Chaiken | 368/285 |
| 1,689,471 | 10/1928 | Andrusis | 368/223 |
| 3,733,805 | 5/1973 | Reiter et al. | 368/223 |

*Primary Examiner*—Vit Miska

[57] ABSTRACT

A wristwatch with an illuminated ornamental display system comprising a case. The case has a bottom wall in a circular configuration with an upstanding side wall and with an open top to form a chamber there within. The bottom wall has a periphery for releasably coupling with the remainder of the case. A support plate has a peripheral edge coupled to the interior of the side wall of the case. The support plate includes a small circular opening in the center of a first hemisphere and an enlarged oval opening in the center of a second hemisphere. A timing assembly has a container beneath the small opening with upstanding concentric rods extending through the small opening and with hands coupled to the rods for the indication of time. An illuminatable ornamental display assembly includes a member of a translucent material with a base received within the enlarged opening and a raised surface above the upper surface of the support plate. The display assembly also has a light beneath the member.

9 Claims, 2 Drawing Sheets

68
10
22
48
42
50
44
14
52

26
28
10
3
3
38
34
40
58

56
54
22
52
30
32
24
58
64
66
18
20
46
36
60
62
14
16

FIG 5
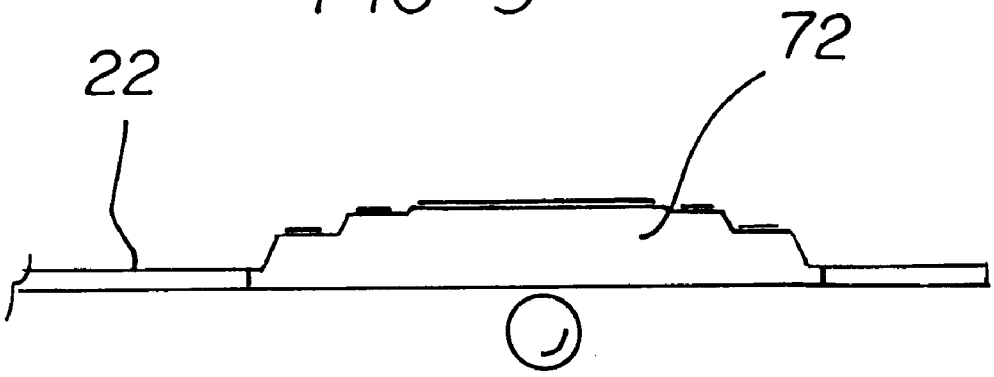
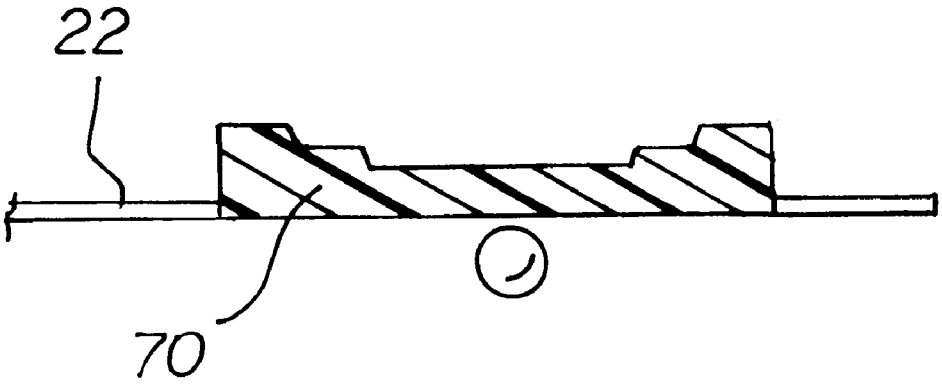
FIG 4

WRISTWATCH WITH AN ILLUMINATED ORNAMENTAL DISPLAY SYSTEM

BACKGROUND OF THE INVENTION

1. Field of the Invention

The present invention relates to a wristwatch with an illuminated ornamental display system and more particularly pertains to enhancing the readability and ornamental appearance of wristwatches.

2. Description of the Prior Art

The use of wristwatches with illumination components of known designs and configurations is known in the prior art. More specifically, wristwatches with illumination components of known designs and configurations heretofore devised and utilized for the purpose of illuminating wristwatch faces through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,114,236 issued Dec. 17, 1963, to B. Ross discloses an Illumination Device for Wrist Watches. U.S. Pat. No. 3,514,939 issued Jun. 2, 1970, to E. C. Cattin discloses a Multiple-reading Watch with Built-in Electric Lighting Means. U.S. Pat. No. 3,681,587 issued Aug. 1, 1972, to Brien discloses a Wrist Watch with Dial Illuminating Device. U.S. Pat. No. 3,992,872 issued Nov. 23, 1976, to Stanish discloses a Display Device. U.S. Pat. No. 4,335,453 issued Jun. 15, 1982, to Fatton discloses an Electronic Watch. U.S. Pat. No. 4,407,091 issued Oct. 4, 1983, to Moody discloses a Wrist Attached Rattle and Educational Device for Infants. U.S. Pat. No. 4,417,819, issued Nov. 29, 1983, to Migeon discloss a Watchband Light Attachment for a Wristwatch. U.S. Pat. No. 4,972,394 to DiMarco discloses a Multipurpose External Watch Face Illuminator. U.S. Pat. No. 5,339,294 issued Aug. 16, 1994, to Rodgers discloss a Watch with Light Means. U.S. Pat. No. 5,400,301, issued Mar. 21, 1995, to Rackley discloses a Wrist Watch Alarm. U.S. Pat. No. 5,734,627 issued Mar. 31, 1998, to Sy discloses a Silhouette Image on Illuminated Watch Dial. Lastly, U.S. Pat. No. 5,883,862 issued Mar. 16, 1999, to Wang discloses a Clock Having Emergency Lighting Device.

While these devices fulfill their respective, particular objectives and requirements, the aforementioned patents do not describe a wristwatch with an illuminated ornamental display system that allows enhancing the readability and ornamental appearance of wristwatches.

In this respect, the wristwatch with an illuminated ornamental display system according to the present invention substantially departs from the conventional concepts and designs of the prior art, and in doing so provides an apparatus primarily developed for the purpose of enhancing the readability and ornamental appearance of wristwatches.

Therefore, it can be appreciated that there exists a continuing need for a new and improved wristwatch with an illuminated ornamental display system which can be used for enhancing the readability and ornamental appearance of wristwatches. In this regard, the present invention substantially fulfills this need.

SUMMARY OF THE INVENTION

In view of the foregoing disadvantages inherent in the known types of wristwatches with illumination components of known designs and configurations now present in the prior art, the present invention provides an improved wristwatch with an illuminated ornamental display system. As such, the general purpose of the present invention, which will be described subsequently in greater detail, is to provide a new and improved wristwatch with an illuminated ornamental display system and method which has all the advantages of the prior art and none of the disadvantages.

To attain this, the present invention essentially comprises a new and improved wristwatch with an illuminated ornamental display system comprising, in combination a case. The case has a bottom wall formed in a circular configuration with an upstanding side wall and with an open top. forming a chamber within the case. The bottom wall has a threaded periphery for releasably coupling with the remainder of the case. A support plate has a peripheral edge coupled to the interior of the side wall of the case at an intermediate elevation thereof. The support plate includes two laterally spaced hemispheres with a small circular opening in the center of the first hemisphere and an enlarged oval opening in the center of the second hemisphere. A timing assembly has a container coupled with respect to the support plate beneath the small opening. Upstanding concentric rods extend through the small opening. A long minute hand and a short hour hand are coupled to the rods above the support plate for the indication of time. A battery is removably received in the bottom of the timing assembly and is accessible through the temporary removal of the bottom wall of the case. An illuminatable ornamental display assembly includes a cameo of a translucent material. The cameo has an oval base received within the enlarged opening of the support plate. The cameo also has a raised surface above the upper surface of the support plate. The raised surface is carved ornamentally for the refraction of light transmitted through the cameo. The display assembly also has a light bulb coupled with respect to the support plate centrally beneath the cameo. A receptable is provided for removably supporting the light bulb with respect to the display assembly. A battery is removably received in the bottom of the display assembly and is accessible through the temporary removal of the bottom wall of the case. A rotatable stem has an interior end coupled with respect to the timing assembly and extends through a first aperture in the side wall. An exterior end functions for the adjustment of the position of the hands. An axially shiftable rod has an interior end coupled to the display assembly and extends through a second aperture in the side wall and is diametrically opposed to the first aperture and has an exterior end adapted to be depressed by a user. In this manner the display assembly is activated to illuminate the bulb and transmit light through the cameo to the region adjacent to the upper surface of the support plate and the hands. A transparent crystal is positioned over the upper face from the upper edge of the case to protect the face, hands and cameo of the watch.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved wristwatch with an illuminated ornamental display system which has all of the advantages of the prior art wristwatches with illumination components of known designs and configurations and none of the disadvantages.

It is another object of the present invention to provide a new and improved wristwatch with an illuminated ornamental display system which may be easily and efficiently manufactured and marketed.

It is further object of the present invention to provide a new and improved wristwatch with an illuminated ornamental display system which is of durable and reliable constructions.

An even further object of the present invention is to provide a new and improved wristwatch with an illuminated ornamental display system which is susceptible of a low cost of manufacture with regard to both materials and labor, and which accordingly is then susceptible of low prices of sale to the consuming public, thereby making such a wristwatch with an illuminated ornamental display system economically available to the buying public.

Even still another object of the present invention is to provide a wristwatch with an illuminated ornamental display system for enhancing the readability and ornamental appearance of wristwatches.

Lastly, it is an object of the present invention to provide a new and improved wristwatch with an illuminated ornamental display system comprising a case having a bottom wall in a circular configuration with an upstanding side wall and with an open top to form a chamber there within, the bottom wall having a periphery for releasably coupling with the remainder of the case, a support plate having a peripheral edge coupled to the interior of the side wall of the case, the support plate including a small circular opening in the center of a first hemisphere and an enlarged oval opening in the center of a second hemisphere, a timing assembly having a container beneath the small opening with upstanding concentric rods extending through the small opening and with hands coupled to the rods for the indication of time, and an illuminatable ornamental display assembly including a member of a translucent material with a base received within the enlarged opening and a raised surface above the upper surface of the support plate, the display assembly also having a light beneath the member.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a cross-sectional view similar to FIG. 3 but illustrating an alternate embodiment of the invention.

FIG. 5 is a cross-sectional view similar to FIG. 4 but illustrating a further alternate embodiment of the invention.

The same reference numerals refer to the same parts throughout the various Figures.

DESCRIPTION OF THE PREFERRED EMBODIMENT

Figure 1:
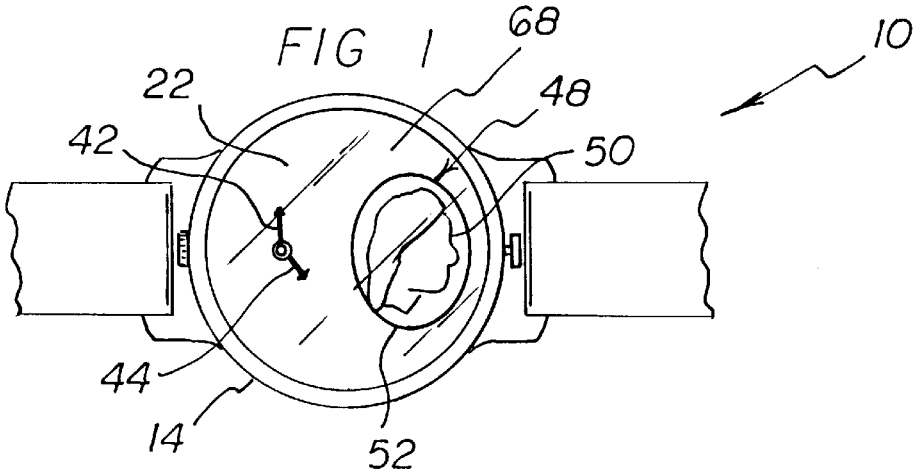
FIG. 1 is a front elevational view of the new and improved wristwatch with an illuminated ornamental display system constructed in accordance with the principles of the present invention.

With reference now to the drawings, and in particular to FIG. 1 thereof, the preferred embodiment of the new and improved wristwatch with an illuminated ornamental display system embodying the principles and concepts of the present invention and generally designated by the reference numeral 10 will be described.

The present invention, a wristwatch with an illuminated ornamental display system 10 is comprised of a plurality of components. Such components in their broadest context include a case, a support plate, a timing assembly, and an illuminatable ornamental display assembly. Such components are individually configured and correlated with respect to each other so as to attain the desired objective.

The case 14 has a bottom wall 16 formed in a circular configuration with an upstanding side wall 18 and with an open top forming a chamber within the case. The bottom wall has a threaded periphery 20 for releasably coupling with the remainder of the case.

A support plate 22 has a peripheral edge 24 coupled to the interior of the side wall of the case at an intermediate elevation thereof. The support plate includes two laterally spaced hemispheres 26, 28 with a small circular opening 30 in the center of the first hemisphere and an enlarged, preferably oval in shape, opening 32 in the center of the second hemisphere.

A timing assembly 34 has a container 36 coupled with respect to the support plate beneath the small opening. Upstanding concentric rods 38, 40 extend through the small opening. A long minute hand 42 and a short hour hand 44 are coupled to the rods above the support plate for the indication of time. A battery 46 is removably received in the bottom of the timing assembly and is accessible through the temporary removal of the bottom wall of the case.

An illuminatable ornamental display assembly 48 includes a cameo 50 of a translucent material. The cameo has an oval base 52 received within the enlarged opening of the support plate. The cameo is preferably made of a natural material but it may be of a synthetic material such as a hard, translucent plastic. The cameo has a raised surface 54 above the upper surface of the support plate. The raised surface is carved ornamentally 56 for the refraction of light transmitted through the cameo. The display assembly also has a light bulb 58 coupled with respect to the support plate centrally beneath the cameo. A receptable 60 is provided for removably supporting the light bulb with respect to the display assembly. A battery 62 is removably received in the bottom of the display assembly and is accessible through the temporary removal of the bottom wall of the case.

A rotatable stem 64 has an interior end coupled with respect to the timing assembly and extends through a first aperture in the side wall. An exterior end functions for the adjustment of the position of the hands.

An axially shiftable rod 66 has an interior end coupled to the display assembly and extends through a second aperture in the side wall and is diametrically opposed to the first aperture. The rod has an exterior end with a button adapted to be depressed by a user. In this manner the display assembly is activated to illuminate the bulb and transmit light through the cameo to the region adjacent to the upper surface of the support plate and the hands. The depression of the button will preferably illuminate the bulb in a predetermined period sufficient to read the watch hands and determine the time. In the alternate embodiment, the depression of the button will illuminate the bulb so long as the button remains depressed.

A transparent crystal 68 is positioned over the upper face from the upper edge of the case. This is to protect the face, hands and cameo of the watch.

Figure 2:
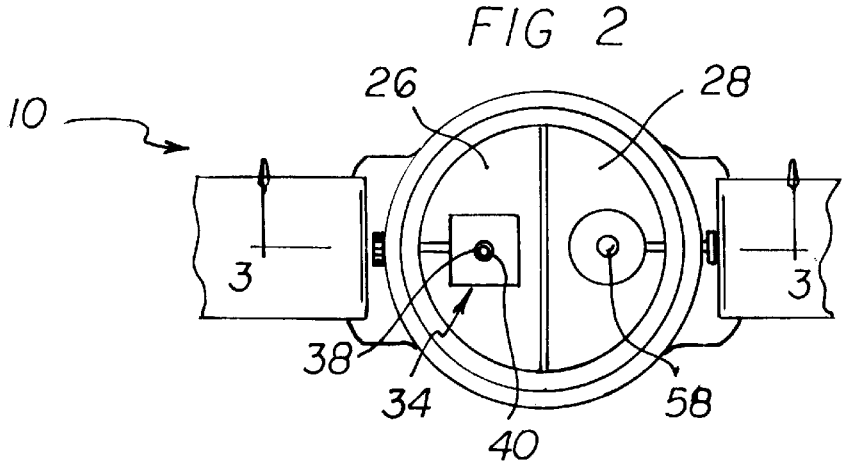
FIG. 2 is front elevational view of the watch shown in FIG. 1 but with the support plate removed.
Figure 3:
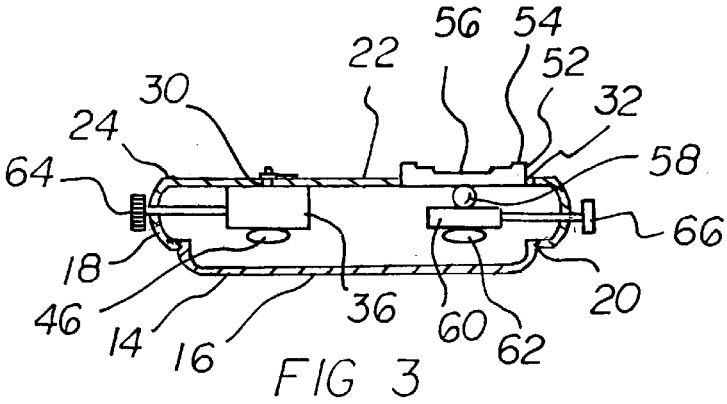
FIG. 3 is a cross-sectional view taken along line 3—3 of FIG. 1.

The primary embodiment of applicant's invention, the best mode for carrying out the invention, is shown in FIGS. 1 through 3. Such embodiment features a cameo, preferably fabricated of natural materials, such as shell, with a face or other ornamental indicia carved therein. An alternate embodiment is shown in FIG. 4.

In the embodiment of FIG. 4, the cameo is replaced with an alternate translucent member. Such member is an intaglio 70. An intaglio is a translucent member with carvings formed downwardly therein, rather than upwardly, as in the cameo.

A further alternate embodiment is shown in FIG. 5. In the FIG. 5 embodiment, the cameo material of the translucent member is replaced with a hard plastic material 72, in effect, an artificial cameo or intaglio. In the FIG. 5 embodiment, the plastic translucent member is shown as having a smoother surface. It should be understood that such smooth surface could be formed with carvings, as in the cameo or the intaglio described above. In the FIG. 5 embodiment, however, the exterior surface of the translucent member is simply formed with paint 74 thereover in the form of a decoration to enhance its appearance. Such paint, however, being in different locations on the exterior surface of the translucent member, will act like the cameo or intaglio of the prior embodiments in refracting light passed therethrough from the bulb there below for a more pleasing decorative effect to the watch face and hands being illuminated.

It should be understood that one translucent member is shown on one watch face located within an enlarged opening. Such showing is for illustrative purposes only. The translucent member could be placed over the opening, not within, and adhered or otherwise secured thereto. In this manner, the design on the translucent member is replaceable to suit the desires of a wearer and might include art work, monograms, team logos, company indicia, etc.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desiread to be protected by Letters Patent of the United States is as follows:

1. A new and improved wristwatch with an illuminated ornamental display system comprising, in combination:

a case having a bottom wall in a circular configuration with an upstanding side wall and with an open top to form a chamber therewithin, the bottom wall having a threaded periphery for releasably coupling with the remainder of the case;

a support plate having a peripheral edge coupled to the interior of the side wall of the case at an intermediate elevation thereof, the support plate including two laterally spaced hemispheres with a small circular opening in the center of the first hemisphere and an enlarged oval opening in the center of the second hemisphere;

a timing assembly having a container coupled with respect to the support plate beneath the small opening with upstanding concentric rods extending through the small opening and with a long minute hand and a short hour hand coupled to the rods above the support plate for the indication of time and with a battery removably received in the bottom of the timing assembly and accessible through the temporary removal of the bottom wall of the case;

an illuminatable ornamental display assembly including a cameo of a translucent material with an oval base received within the enlarged opening of the support plate and a raised surface above the upper surface of the support plate carved ornamentally for the refraction of light transmitted through the cameo, the display assembly also having a light bulb coupled with respect to the support plate centrally beneath the cameo with a receptable for removably supporting the light bulb with respect to the display assembly and with a battery removably received in the bottom of the display assembly and accessible through the temporary removal of the bottom wall of the case;

a rotatable stem having an interior end coupled with respect to the timing assembly and extending through a first aperture in the side wall there adjacent and with an exterior end for the adjustment of the position of the hands;

an axially shiftable rod having an interior enc coupled to the display assembly and extending through a second aperture in the side wall there adjacent diametrically opposed to the first aperture and with an exterior end adapted to be depressed by a user for activating the display assembly to illuminate the bulb and transmit light through the cameo to the region adjacent to the upper surface of the support plate and the hands; and a transparent crystal positioned over the upper face from the upper edge of the case to protect the face, hands and cameo of the watch.

2. A wristwatch with an illuminated ornamental display system comprising:

a case having a bottom wall in a circular configuration with an upstanding side wall and with an open top to form a chamber therewithin, the bottom wall having a periphery for releasably coupling with the remainder of the case;

a support plate having a peripheral edge coupled to the interior of the side wall of the case, the support plate including a small circular opening in the center of a first hemisphere and an enlarged oval opening in the center of a second hemisphere;

a timing assembly having a container beneath the small opening with upstanding concentric rods extending through the small opening and with hands coupled to the rods for the indication of time; and an illuminatable ornamental display assembly including a member of a translucent material with a base received within the enlarged opening and a raised surface above the upper surface of the support plate, the display assembly also having a light beneath the member.

3. A wristwatch as set forth in claim 2 and further including a rotatable stem having an interior end coupled with respect to the timing assembly and extending through a first aperture in the side wall there adjacent and with an exterior end for the adjustment of the position of the hands.

4. A wristwatch as set forth in claim 3 and further including an axially shiftable rod having an interior enc coupled to the display assembly and extending through a second aperture in the side wall there adjacent diametrically opposed to the first aperture and with an exterior end adapted to be depressed by a user for activating the display assembly to illuminate the bulb and transmit light through the cameo to the region adjacent to the upper surface of the support plate and the hands.

5. A wristwatch as set forth in claim 2 and further including a transparent crystal positioned over the upper face of the upper edge of the case to protect the hands and cameo.

6. The system as set forth in claim 2 wherein the translucent member is a cameo.

7. The system as set forth in claim 2 wherein the translucent member is an intaglio.

8. The system as set forth in claim 2 wherein the translucent member is plastic.

9. The system as set forth in claim 2 wherein the translucent member is plastic with indicia formed on its exterior surface.

* * * * *